United States Patent [19]

Dunsworth

[11] Patent Number: 4,566,242

[45] Date of Patent: Jan. 28, 1986

[54] SMOKE AND HEAT BARRIER

[75] Inventor: Charles L. Dunsworth, Midwest City, Okla.

[73] Assignee: Metalines, Inc., Oklahoma City, Okla.

[21] Appl. No.: 557,483

[22] Filed: Dec. 2, 1983

[51] Int. Cl.[4] ..... E04B 1/68

[52] U.S. Cl. ..... 52/573; 52/466

[58] Field of Search ..... 52/573, 396, 467, 466, 52/461, 317; 428/421, 446, 236, 921

[56] References Cited

U.S. PATENT DOCUMENTS

| | | | |
|---|---|---|---|
| 3,300,913 | 1/1967 | Patry et al. | 52/58 |
| 3,659,390 | 5/1972 | Balzer et al | 52/573 |
| 4,055,925 | 11/1977 | Wasserman et al. | 52/403 |
| 4,204,856 | 5/1980 | Yigdall | 65/157 |
| 4,246,313 | 1/1981 | Stengle, Jr. | 428/266 |
| 4,473,015 | 9/1984 | Hounsel | 52/474 X |

*Primary Examiner*—Carl D. Friedman

*Attorney, Agent, or Firm*—Robert M. Hessin

[57] ABSTRACT

A heat insulative barrier for use in isolating potential fire zones relative to expansion joint voids which comprises the use of a sealed sheet of ceramic felt material secured across an expansion void and including one or more refractory cloth sheets sealingly secured contiguous to the ceramic felt sheet on one or both sides thereof and adjacent to the potential fire zone.

7 Claims, 3 Drawing Figures

SMOKE AND HEAT BARRIER

BACKGROUND OF THE INVENTION

1. Field of the Invention

The invention relates generally to smoke and heat barrier structure as used in building construction and, more particularly, but not by way of limitation, it relates to improved fire barrier structure and its utilization with expansion joint assemblies.

2. Description of the Prior Art

The prior art includes various forms of expansion joints and insulative barriers of the type that provides normal thermal insulation, i.e. outside weather conditions versus protected inner heat conditions and the like. No prior patent has been found that is specifically directed to heat resistive materials for use as a high intensity heat and smoke barrier under extreme fire and smoke conditions. U.S. Pat. No. 3,300,913 in the name of Patry is representative of a general form of expansion cover that includes an inner insulating foam that is further contained by an outer elastic strip. U.S. Pat. No. 4,055,925 teaches an expansion joint that is made up of a three-layer structure which includes a layer of woven wire cloth impregnated or coated with asphalt substance at specified points. These types of barrier do not exhibit high intensity heat resistance.

SUMMARY OF THE INVENTION

The present invention relates to an improved construction of a fire barrier that is used in conjunction with structural expansion joint assemblies. The barrier consists of a combination of insulative fabric substances as sealingly disposed to partition or isolate a potential fire and smoke zone. Thus, such barrier structure may be used to seal off an expansion void thereby to coontain a volume of heat and smoke and retard spreading throughout the building structure. More particularly, the fire barrier of the present invention utilizes a primary sheet of a ceramic wool fabric in combination with a closely retained layer of refractory cloth material on one or both sides of the ceramic wool fabric. Further, additional and more loosely draped layers of refractory cloth can be utilized to define dead air spaces as dictated by design criteria.

Therefore, it is an object of the present invention to provide a general purpose, fire-rated heat and smoke barrier structure which may be readily secured to isolate adjoining spaces.

It is further an object of the present invention to provide a fire barrier that is relatively inexpensive yet effective to extremely high heat intensities.

It is still further an object of this invention to provide a smoke and heat barrier that is flexible in design versatility and allows compounding of structure in accordance with the exigencies of the particular design application.

It is also an object of the invention to provide a fire barrier that is readily secured across curtain wall gaps, penetration stops, or shaft stopping between buildings where joint covers cannot be located.

Finally, it is an object of the present invention to provide a relatively simple but reliable smoke and heat barrier which is readily installed in conjunction with various types of building expansion joint assemblies.

Other objects and advantages of the invention will be evident from the following detailed description when read in conjunction with the accompanying drawings which illustrate the invention.

DETAILED DESCRIPTION OF THE INVENTION

Figure 1:
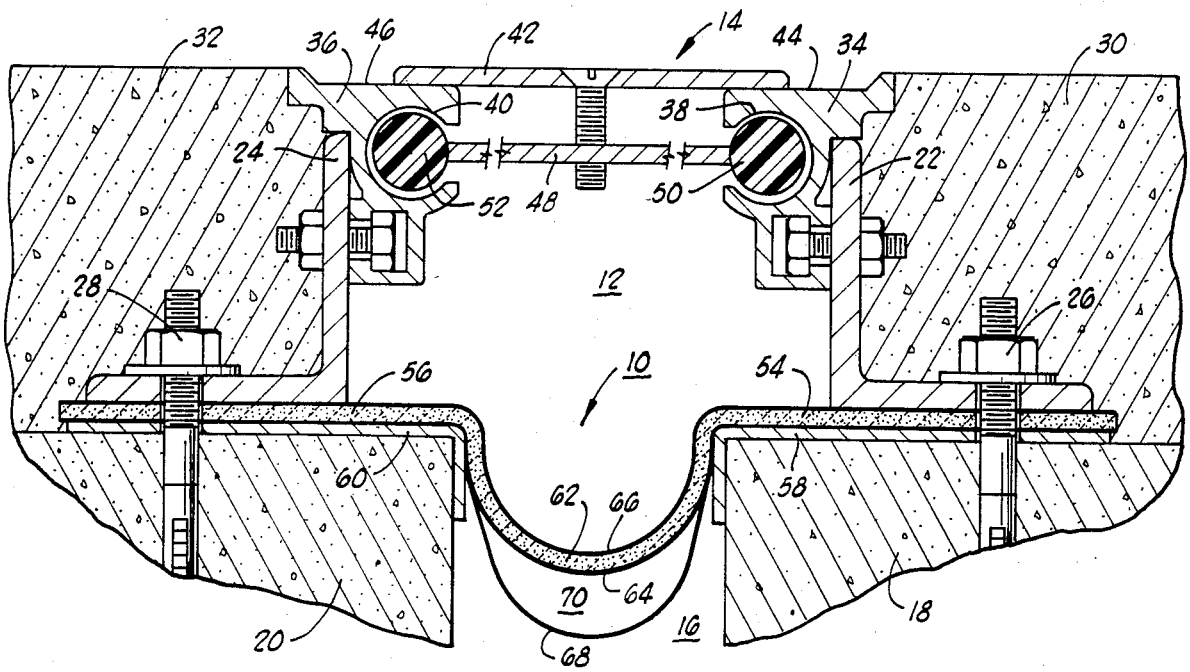
FIG. 1 is a view in section of a typical form of floor expansion joint assembly in combination with a smoke and heat barrier constructed in accordance with the present invention.

Referring to FIG. 1, a smoke and heat barrier 10 is disposed in sealing and insolating affixture within an expansion space or void designated generally by 12 as bridged by an expansion joint assembly 14. Expansion joint assemblies may be used variously in abridgment of walls, floors, ceilings, external openings and the like, assembly 14 being a floor-type joint. The barrier 10 is disposed to isolate and prevent passage of heat and smoke through the expansion void 12 as from interior expansion space 16 through to expansion space 12 and outward therefrom.

The expansion joint assembly 14 is depicted as bridging between cementitious floor panels 18 and 20 as opposite angle brackets 22 and 24 are secured on opposite sides of expansion void 12 by means of a series of concrete anchor fasteners 26 and 28 respectively. The outer surface adjacent expansion joint assembly 14 is then dressed with such as grout surfaces 30 and 32 therealong.

The expansion joint assembly 14 further consists of opposed guide members 34 and 36 defining respective tube ways 38 and 40 as secured by suitable fasteners to opposite angle brackets 32 and 24. An expansion joint cover plate 42 then covers over the expansion void as opposite sides of cover plate 42 are slidably engaged with the top surfaces 44 and 46 of respective guide members 34 and 36, and the cover plate 42 is maintained in centered relationship by means of pivotally attached guidebar 48 as the opposite end plastic slide balls 50 and 52 move within the respective tube ways 38 and 40. A plurality of such centering bars 48 are located in spaced arrangement along the length of cover plate 42.

In order to provide smoke and heat isolation through the expansion void 12, i.e. from inner expansion space 16 to the void space 12 and outward, the barrier 10 is disposed in loose, relatively draped positioning with opposite sides 54 and 56 sealingly seized between the base plates of opposite angle brackets 22 and 24 and respective shoulder plates 58 and 60 are secured in shoulder facing to panels 18 and 20. The masonry fasteners 26 and 28 maintain all components in rigid sealed engagement. The barrier 10 may be variously constituted of a heavier sheet of ceramic wool or felt 62 as applied with one or more of an inner refractory cloth sheet 64 and an outer refractory cloth sheet 66. Still further, one or more loosely draped sheets of refractory cloth 68 may also be included as it defines a further dead air space 70 within the refractory cloth sheeting.

Figure 2:
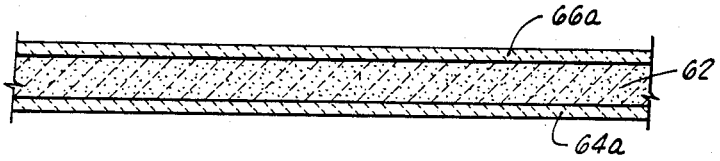
FIG. 2 is a partial sectional view of fire barrier material layers as utilized in FIG. 1.

FIG. 2 represents in section a portion of the barrier that includes an interior ceramic felt sheet 62 sandwiched between refractory cloth sheets **64*a* and 66*a***.

The ceramic felt sheet 62 is a mat of silicon dioxide and Alumina-Silica ceramic fibers of relatively tight, matted composition having a melting point of about 3100° F. Such ceramic wool or felt material is commercially available from the Carborundum Company, Niagria Falls, N.Y. The outer refractory cloth sheets 64*a* and 66*a* may be stitched or bonded using suitable bonding agents to the opposite sides of ceramic felt 62; however, in most applications this would not be necessary since either the weight of gravity or the lay of the fabric will usually maintain the sheets in proper contiguous positioning relative to one another. This is not critical, and as in the case of the spaced refractory cloth sheet 68 defining dead air space 70, the spacing may be specifically effected.

The refractory cloth sheets 64*a*, 66*a*, 68 and the like, may be such as silica fiber cloth or alumina silica cloth or other heat resistive fibers from the general class. In a preferred form, the refractory cloth is a high purity silica fiber cloth, that is pre-shrunk as formed from white, vitreous fibers having up to 99% silicon dixode content. Such stock is available in bulk fiber, yarn, etc. but is utilized in the present invention in continuous cloth lengths as sold under the name "REFRASIL", commercially available from Hitco Corporation of Gardena, Calif. Still to be preferred is to impregnate the refractory cloth or silica fiber cloth thoroughly with a self-extinguishing silicone rubber to provide a water resistant coating with still greater barrier efficiency. The silicon rubber impregnated silica fiber cloth is commercially available under the name "METAFLEX" from Metalines, Inc. of Oklahoma City, Okla. The silica fiber cloth has a melting point at about 3100° F. and the impregnating and coating silicone rubber has a melting point upwards of 500° F. with residual cloth sealing properties extending to much higher temperatures. Thus, the Metaflex material provides a flexible yet smoke impervious barrier material that is non-flammable to temperatures far exceeding 500° F.

Figure 3:
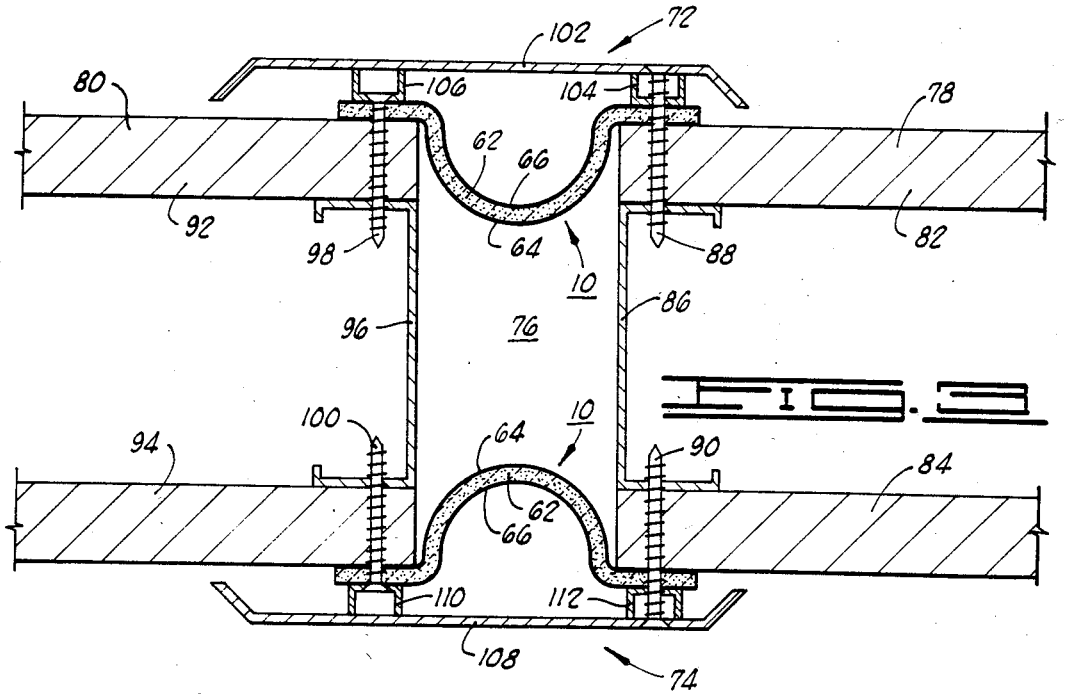
FIG. 3 is a view in section of another form of wall expansion joint assembly utilizing smoke and heat barriers as constructed in accordance with the present invention.

FIG. 3 illustrates the use of oppositely disposed heat barriers 10 as employed in a wall panel expansion joint with respective opposite wall panel expansion joint assemblies 72 and 74. Thus, the expansion joint void 76 is formed between butt ends of respective adjoining wall panels 78 and 80. The panel 78 consists of one or more opposite panels of gypsum wallboard of the like 82 and 84 are connected by a stud bracket 86 secured by such as screw fasteners 88 and 90. Similarly, adjoining panel 80 is formed by opposite panels 92 and 94 joined by stud bracket 96 as secured by screw fasteners 98 and 100. Expansion joint assembly 72 consists of a cover plate 102 secured along one side by means of screw fastener 88 through a U-shaped channel 104 which tightly engages one side of a barrier member 10 in sealing affixure to the panel 82. The opposite side of the barrier is sealingly secured by a channel 106 secured by fastener 98 as cover plate 102 is slidingly contacting the channel 106. In like manner, the opposite expansion joint assembly 74 consists of the sliding cover plate 108 in contact with channel 110 as the opposite side of cover plate 108 is secured by means of fastener 90 through channel 112.

The opposed barriers 10 consist of the ceramic felt interior portion 62 sandwiched between opposite side refractory cloth sheetings 64 and 66, and sufficient slack material is provided to allow for maximum expansion separation of the adjoining wall panels 78 and 80. In addition, still other combinations of refractory sheet material and/or multiple wallboard layers at various spacings may be utilized to provide particular dead air space configurations within the expansion void space.

The foregoing discloses a novel arrangement of temperature resistive fabrics and woven material as may be utilized for isolating heat and smoke as between interior spaces utilizing expansion joints. The barrier structure provides a relatively inexpensive yet easily applied and long-lasting fire barrier that serves to limit heat and smoke effects up to considerably high temperature levels. The present invention provides yet another degree of security as regards heat and smoke transmission through building walls and surfaces that require expansion spacing.

Changes may be made in combination with arrangement of elements as heretofor set forth in this specification and shown in the drawings; it being understood that changes may be made in the embodiments disclosed without departing from the spirit and scope of the invention as defined in the following claims.

What is claimed is:

1. An expansion joint assembly including fire barrier for disposition across an expansion void between expansible, adjoining first and second panel strutures, comprising:

an expansion joint including first and second brackets and guide members secured along first and second panel structures with guidebar means slidingly secured to said first and second panel structures and pivotally secured to said expansion cover to maintain the expansion cover in secure sliding engagement over said first and second bracket and guide members; a resilient ceramic felt sheet sealingly secured by said first and second bracket and guide members to extend between said first and second panel structures in spaced relationship from said expansion cover; and a first refractory cloth sheet sealingly secured between said first and second panel structures and disposed generally contiguous to said ceramic felt sheet;

whereby the widths of said ceramic felt sheet and refractory cloth sheet is each markedly greater than the distance across the expansion void.

2. An expansion joint assembly and fire barrier as set forth in claim 1 which further includes:

a second refractory cloth sheet of markedly greater width than said expansion void sealingly secured between said first and second panel structures and disposed contiguous to said ceramic felt sheet on the opposite side from said first refractory cloth sheet.

3. An expansion joint assembly and fire barrier as set forth in claim 1 which further includes:

at least one additional refractory cloth sheet of markedly greater width than said expansion void sealingly secured with said resilient ceramic felt sheet and first refractory cloth sheet but spaced therefrom to define a dead air space.

4. An expansion joint assembly and fire barrier as set forth in claim 1 wherein:

said refractory cloth is a silicon dioxide fabric.

5. An expansion joint assembly and fire barrier as set forth in claim 4 wherein:

said silicon dioxide fabric is coated with silicone rubber.

6. An expansion joint assembly and fire barrier as set forth in claim 1 wherein:

7. An expansion joint assembly and fire barrier as set forth in claim 6 wherein:

said alumina-silica fabric is coated with silicone rubber.

* * * * *

UNITED STATES PATENT AND TRADEMARK OFFICE

CERTIFICATE OF CORRECTION

PATENT NO. : 4,566,242

DATED : January 28, 1986

INVENTOR(S) : Charles L. Dunsworth

It is certified that error appears in the above-identified patent and that said Letters Patent are hereby corrected as shown below:

Column 1, lines 37 and 38, change the word "coontain" to --contain--; Column 2, line 19, change the word "affixture" to --affixure--; Column 2, line 40, change the number "32" to --22--; Column 4, line 30, the words "a resilient" should be the beginning of a new sub-part of claim 1; and Column 4, line 63, the rest of claim 6 was left off and should read as follows after the colon --said refractory cloth is an alumina-silica fabric.--.

Signed and Sealed this

*Thirteenth* Day of *May 1986*

[SEAL]

*Attest:*

DONALD J. QUIGG

*Attesting Officer*

*Commissioner of Patents and Trademarks*